US006578481B1

(12) United States Patent
Beisel et al.

(10) Patent No.: US 6,578,481 B1
(45) Date of Patent: Jun. 17, 2003

(54) METHOD AND DEVICE FOR OPERATING A ROTARY PRINTING PRESS

(75) Inventors: Hermann Beisel, Walldorf (DE); Rudi Junghans, Wilhelmsfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 298 days.

(21) Appl. No.: 09/213,726

(22) Filed: Dec. 17, 1998

(30) Foreign Application Priority Data

Dec. 17, 1997 (DE) ..... 197 56 077

(51) Int. Cl.[7] ..... B41F 31/00
(52) U.S. Cl. ..... 101/350.3
(58) Field of Search ..... 101/348–362, 101/DIG. 6, DIG. 14, 148, 206–209

(56) References Cited

U.S. PATENT DOCUMENTS

| | | | | |
|---|---|---|---|---|
| 4,205,605 A | * | 6/1980 | Greiner et al. | 101/206 |
| 4,332,195 A | * | 6/1982 | Mizumura | 101/349 |
| 4,397,236 A | * | 8/1983 | Greiner et al. | 101/350 |
| 4,513,663 A | * | 4/1985 | Hummel et al. | 101/349 |
| 4,620,481 A | * | 11/1986 | Steiner | 101/350 |
| 4,914,981 A | * | 4/1990 | Hummel et al. | 74/837 |
| 5,134,939 A | * | 8/1992 | Borne | 101/349 |
| 5,158,019 A | * | 10/1992 | Miescher et al. | 101/349 |
| 5,249,523 A | | 10/1993 | Kanzler et al. | |
| 5,701,817 A | | 12/1997 | Thünker et al. | |

FOREIGN PATENT DOCUMENTS

| | | | |
|---|---|---|---|
| EP | 0047861 | * | 3/1982 |
| EP | 0 545 237 A1 | | 6/1993 |
| EP | 0 705 692 A1 | | 4/1996 |
| FR | 2 271 932 | | 12/1975 |
| GB | 2 180 502 A | | 4/1987 |

* cited by examiner

*Primary Examiner*—Eugene H. Eickholt
(74) *Attorney, Agent, or Firm*—Laurence A. Greenberg; Werner H. Stemer; Ralph E. Locher

(57) ABSTRACT

A device for varying the stroke amplitude of at least one axially oscillating distributor roller in an application unit of a rotary printing press, includes a distributor roller drivable by a distributor stroke drive via a distributor stroke transmission including a coulisse having a groove and being adjustable from a first position to a second position, and a sliding block movable in the groove. The device having a first transmission member carrying the coulisse, and a second transmission member carrying the sliding block. The distributor stroke transmission is formed of the first and second transmission members. The coulisse is disposed adjustably relative to the first transmission member. Both first and second transmission members are drivable by the distributor stroke drive. The device also has an actuator for adjusting the coulisse. The actuator is carried by at least one of the first and second transmission members.

10 Claims, 8 Drawing Sheets

METHOD AND DEVICE FOR OPERATING A ROTARY PRINTING PRESS

BACKGROUND OF THE INVENTION

Field of the Invention

The invention relates to a method and device for operating a rotary printing press which includes an inking unit having at least one ink distributor roller that oscillates axially with a variable stroke amplitude.

With regard to the method of the invention, it is noted that operating methods have become known heretofore that provide for continued operation of the printing unit without transporting printing material and of the inking unit without feeding and removing ink, whenever interruptions in operation should occur. Lateral distribution is reduced so that in this operating state the ink layer thickness profile, which varies zone by zone in the inking unit, is preserved. Before resumption of the printing mode, predampening of the inking unit is performed. The predampening is necessary so that the ink/dampening medium balance in the inking unit and on the printing form, which was interfered with by dampening-medium evaporation during the interruption, is adjusted immediately to a value favorable for the production run, thereby preventing the development of spoiled copies or waste.

The published European Patent Document EP 0 545 237 B1 describes an inking unit wherein a resumption of a traversing motion of distributor rollers is performed simultaneously with the positioning of ink applicator rollers against a printing form. This can be effected by linking the "printing on" command by circuitry to a tripper device that actuates a switch coupling of the distributor roller, and by linking the tripper device to a pneumatic cylinder that sets the ink applicator rollers into and out of position, respectively. With an inking unit that can be operated in this manner, the ink profile crosswise to the printing direction is able to be maintained considerably longer during the interruption than if there were continued distribution, yet no favorable inking of the printing form is able to be achieved.

The published European Patent Document EP 0 705 692 A1 describes a method and a device for repositioning an inking unit, but they do not overcome the aforementioned inadequacies of the prior art.

With regard to the device according to the invention, it has become known heretofore to use devices for varying lateral-distribution stroke, with which the stroke of a rotating distributor roller can be increased and decreased with the inking unit operating.

In the published German Patent Document DE 36 29 825 A1, a device for axially adjusting the distributor rollers is described, with which the axial motion of the distributor rollers can be regulated from zero to a maximum, and which includes a regulating segment with a drive groove. The regulating segment is rotatably supported on a shaft in a side wall. A device constructed in this manner is technically less complicated to produce, in comparison with the device described in the aforementioned European Patent Document EP 0 545 237 B1, and is less vulnerable to malfunction, because no correctly in-phase latching of coupling parts need be taken into consideration structurally, yet it takes up a great amount of space. Furthermore, an abrupt change between a minimal stroke and a maximal stroke is not possible, because the rotation and locking of the regulating segment with the aid of the gear wheels still takes a relatively long time.

In the German Patent Document DE 25 07 179 C2, a drive for traversing distributor rollers is described that does not overcome the inadequacies of this last-described reference in the prior art.

SUMMARY OF THE INVENTION

It is accordingly an object of the invention to provide a method and device for driving a rotary printing press by which the number of spoiled copies resulting from brief interruptions in the operation of the rotary printing press is minimized.

With the foregoing and other objects in view, there is provided, in accordance with one aspect of the invention, a method for operating a rotary printing press including an inking unit having at least one ink distributor roller that oscillates axially with a variable stroke amplitude, which comprises operating the rotary printing press in a "printing interruption" operating mode, wherein the ink distributor roller oscillates with minimal stroke, and subsequently operating the rotary printing press in a "printing operation" operating mode, wherein the ink distributor roller oscillates with a normal stroke, and before beginning to operate the rotary printing press in the "printing operation" operating mode, increasing the stroke amplitude of the ink distributor roller.

In accordance with another mode, the method of the invention includes increasing the stroke amplitude from the minimal stroke to the normal stroke.

In accordance with a further mode of the method of the invention, the inking unit has at least one ink applicator roller engageable with and disengageable from a printing form, and the method includes increasing the stroke amplitude when the ink applicator roller is disengaged from the printing form.

In accordance with an added mode of the method of the invention, the inking unit has a plurality of the ink applicator rollers, and the method includes increasing the stroke magnitude when all of the plurality of ink applicator rollers are disengaged from the printing form.

In accordance with an additional mode of the method of the invention, the rotary printing press is a planographic press, and the method includes, before beginning to operate the rotary printing press in the "printing operation" operating mode, predampening the printing unit while thus increasing the stroke amplitude of the ink distributor roller.

In accordance with yet another mode, the method of the invention includes increasing the stroke amplitude to the normal stroke.

In accordance with yet a further mode of the method of the invention, the press is an offset printing press.

In accordance with yet an added mode, the method of the invention includes activating a feeding of dampening medium into the inking unit for the predampening simultaneously with increasing the stroke amplitude of the ink distributor roller.

In accordance with yet an additional mode, the method of the invention includes activating a feeding of dampening medium into the inking unit for the predampening after increasing the stroke amplitude of the ink distributor roller.

In accordance with still another mode of the method of the invention, the planographic press has a dampening unit, and the method includes feeding dampening medium from the dampening unit to the inking unit via at least one roller connecting the inking unit to the dampening unit.

In accordance with still a further mode of the method of the invention, the dampening unit includes at least one dampening medium applicator roller engageable with and disengageable from the printing form, and the method includes predampening the inking unit when the dampening medium applicator roller is disengaged from the printing form.

In accordance with still an added mode of the method of the invention, the minimal stroke is at standstill and has a magnitude of zero.

In accordance with still an additional mode, the method of the invention includes varying the stroke amplitude of the ink distributing roller by triggering a device.

In accordance with another mode, the method of the invention includes triggering the device by an electronic control unit.

In accordance with a further mode of the method of the invention, the device that is triggered for varying the stroke amplitude is an adjustable entrainer having a coulisse and a sliding block.

In accordance with another aspect of the invention, there is provided a device for varying the stroke amplitude of at least one axially oscillating distributor roller in an application unit of a rotary printing press, wherein a distributor roller is drivable by a distributor stroke drive via a distributor stroke transmission including a coulisse having a groove and being adjustable from a first position to a second position, and a sliding block movable in the groove, comprising a first transmission member carrying the coulisse, and a second transmission member carrying the sliding block, the distributor stroke transmission being formed of the first and the second transmission members, the coulisse being disposed adjustably relative to the first transmission member, and both the first and the second transmission members being drivable by the distributor stroke drive.

In accordance with a further feature of the device of the invention, an oscillating driving motion is transmissible from one of the first and the second transmission members to the other of the first and the second transmission members, and the coulisse and the sliding block are cooperable with one another for forming an entrainer.

In accordance with an added feature of the device of the invention, the coulisse in the first position thereof is substantially perpendicular thereto in the second position thereof.

In accordance with an additional feature, the device of the invention includes an actuator for adjusting the coulisse.

In accordance with yet another feature of the device of the invention, the actuator is carried by at least one of the first and the second transmission members.

In accordance with yet a further feature of the device of the invention, the first transmission member is embodied as a lever pivotable about a lever axis.

In accordance with yet an added feature of the invention, the coulisse is rotatable about a coulisse axis, and the groove is formed as a circular arc.

In accordance with yet an additional feature of the invention, the first transmission member is a lever pivotable about a lever axis, and a mean radius of the groove has a length equivalent to a spacing between the lever axis and the coulisse axis.

In accordance with still another feature of the invention, the lever is formed as a multi-armed lever having a lever arm supporting the coulisse.

In accordance with still a further feature of the device of the invention, the lever is constructed for moving at least two distributor rollers opposite to one another.

In accordance with still an added feature, the device of the invention includes an electronic control unit for controlling the actuator to adjust the coulisse.

In accordance with a further aspect of the invention, there is provided a rotary printing press that includes the device for varying the stroke amplitude of at least one axially oscillating distributor roller.

The invention proceeds from the observation that in operating a printing press in a manner heretofore known in the prior art, the adaptation and compensation operations in the inking unit which are necessary to resume the production run and which are performed after resumption of the printing operation mode result in a relatively high rate of spoiled copies. By practising the invention, it has been discovered that spoiled copies can be minimized if the compensation operations are performed during the printing interruption mode and in particular before the ink applicator roller or rollers are brought into engagement with or positioned against the printing form for inking it. By resumption of lateral distribution even before a new onset of printing after an interruption, optimal liquification of the printing ink for inking the printing form is attained by utilizing the thixotropy of the printing ink. Printing is resumed once printing material is again being transported through the printing unit and printed therein, for example, with a command "printing on" fed into an electronic control unit. With this command, in offset rotary printing presses, a stepwise engagement with or positioning of a rubber blanket cylinder first against a printing form cylinder and then against the impression cylinder can be tripped, while in dilithographic rotary printing presses, positioning a printing form cylinder and an impression cylinder against one another, i.e., into mutual engagement, can be tripped. With the command "printing off", the rubber blanket cylinder can simultaneously be disengaged or positioned away from the printing form cylinder and from the impression cylinder, or the printing form cylinder and the impression cylinder can be disengaged or positioned away from one another.

In the first operating mode, the stroke amplitude of the distributor roller can be increased from a stopped axial stroke or a very short stroke, such as 1 mm. The stroke amplitude can be increased to the normal stroke, which assures favorable lateral distribution during the printing mode, or to an amplitude different from the normal stroke amplitude, i.e., a larger or smaller stroke amplitude. Once the stroke amplitude has been increased in the first operating mode, then a transition to the second operating mode can be effected while continuously preserving this stroke amplitude. However, after an intervening increase, a reduction in the stroke amplitude is also possible, for example, to the minimal stroke, and with the command "printing on", the stroke amplitude is increased yet again upon resumption of the printing operation mode.

The command "printing on" can preferably also trip a positioning of one or more or preferably all the ink applicator rollers against the printing form to ink it. In this embodiment, the ink applicator roller or rollers are positioned away from the printing form during the first operating mode and positioned against the printing form during the second operating mode. Simultaneously with the onset of inking, a previously interrupted feeding of printing ink from an ink reservoir into the inking unit can be reactivated.

In an especially advantageous feature of the method of the invention, provision may be made for dampening the inking unit during the first operating mode. The dampening medium can be delivered to the inking unit for predampening by a dampening medium delivery device, such as a dampening unit with rollers that is present in the printing press anyway.

Tests have shown that for a comparatively short predampening duration period at increased stroke amplitude, such as over the course of three to four press revolutions, a degradation in zonal ink dosage can be averted to a great extent. The inking unit may be constructed directly dependent upon the type of printing press, and the spacing of the ink distributor roller with variable amplitude from this dampening medium delivery device that supplies the dampening medium can be variable depending upon the press type, such as when there are different numbers of inking unit rollers disposed therebetween. The duration (reaction time) until the dampening medium flows or is fed over the inking roller train until it reaches the ink distributor roller can be correspondingly variable. Depending upon the inertia of the system, the predampening dampening medium can be fed to the inking unit before, after, or preferably simultaneously with the increase in stroke amplitude. An essential feature of this advantageous embodiment of the invention is that dampening medium is fed to the inking unit while the ink distributor roller is oscillating at an increased stroke amplitude, compared to the minimal stroke.

Preferably, a dampening unit that can be operated with a variable supply of dampening medium can be used, and operates in predampening with an increased feed output compared with normal operation. To that end, in a lifter dampening unit, the lifter cycle, and in a film-type dampening unit, the rotary speed of the rollers, such as a dipping roller and a metering roller, can be increased. The duration of predampening and of the lateral distribution with increased stroke amplitude can be referred to a given number of revolutions of the printing unit cylinders (press revolutions) and can be both controlled and variably preselected as a function of other operating parameters of the printing press.

In flat-bed rotary printing presses with an inking unit and a dampening unit, predampening can be performed via at least one roller which at least intermittently connects the inking unit to the dampening unit, and by way of which the dampening medium is fed from the dampening unit into the inking unit, for example, directly onto an ink applicator roller. The predampening of the inking unit can be effected simultaneously with predampening of the printing form, for example, with a dampening medium applicator roller engaging with or positioned against the printing form, and ink applicator rollers positioned away or disengaged from the printing form. This embodiment is advantageous if the printing operation mode is resumed again immediately after the predampening. However, the predampening can also be performed with the ink applicator rollers positioned away or disengaged from the printing form, and the dampening medium applicator roller likewise positioned away or disengaged from it. This variation is advantageous when the onset of printing is delayed after the predampening.

Tests have shown that in predampening in the heretofore conventional manner, that is, with the minimal stroke maintained unchanged, smearlike spots occurred at the onset of printing in the dot-matrix surfaces. These spots result in an additional increase in the number of spoiled copies. The cause thereof was found to be that in conventional predampening with minimal lateral ink distribution, the increasingly fed dampening medium, some of which forms a surface film of water, is smoothened inadequately before it is applied to the printing form and the printing ink located thereon. According to the invention, it was discovered that these printing problems can be averted if the dampening medium fed to the inking unit for predampening during the printing interruption, is distributed together with the ink at an increased stroke amplitude compared with the minimal stroke, that is, with full lateral distribution (normal stroke). As a result, a larger proportion of the dampening medium emulsifies into the ink, and furthermore the remaining film of surface water on the inking rollers is smoothened.

The printing unit, the inking unit and the dampening unit can be controlled by an electronic control unit in a manner adapted to one another. This unit can control the motions of positioning the printing unit cylinders and the ink applicator rollers and the dampening medium applicator roller against and away from the printing form cylinder.

In an especially advantageous mode of the method of the invention, provision may be made for the electronic control unit that controls the printing unit, inking unit and dampening unit also to control the device according to the invention for varying the stroke amplitude, and in particular the actuator thereof.

In the device according to the invention, in particular for performing the method of the invention, namely, for varying the stroke amplitude of at least one axially oscillating distributor roller in an applicator unit, in particular in the inking unit, of a rotary printing press, wherein the distributor roller can be driven by a distributing stroke drive via a distributor stroke transmission which includes a coulisse formed with a groove and adjustable from a first position to a second position, and a sliding block movable in the groove, the coulisse is carried by a first transmission member, and the sliding block is carried by a second transmission member of the distributor stroke transmission, the coulisse disposed adjustably relative to the first transmission member, and both transmission members are drivable by the distributor stroke drive.

With this device, the method of the invention can be performed especially favorably, because the device makes a very rapid change in the stroke amplitude of the distributing roller possible at low adjusting forces brought to bear by the actuator. In contrast with the devices of the aforedescribed prior art, wherein the coulisse guide is used in one case as an adjusting member of a coupling transmission and in another case as a guide cam of a thrust crank transmission, the coulisse guide according to the invention functions as a selectively adjustable entrainer or driver, which in particular can be adjusted from a first position to a second position, and from the second position to the first position. By combining the coulisse with the sliding block, an oscillating driving motion, depending upon whether the coulisse or the transmission member carrying the sliding block is the driving or the driven transmission member, can be transmitted from the first transmission member to the second transmission member, or from the second transmission member to the first transmission member. Disposing the slot on a first movable transmission member and the sliding block on a second movable transmission member of the distributor stroke transmission, and the adjustability of the coulisse relative to the transmission member carrying it, makes it possible, because of a simplified structure of the distributor stroke transmission in particular with respect to the rod linkage, to make better use of the installation space and reduce production costs.

A groove should be understood hereinafter to mean both a groove with a bottom face (base) and an oblong slot without a bottom face, and the term sliding block is understood to mean both a sliding block and a roller. The sliding block may have a circular cross section (such as a bolt) or a polygonal cross section (such as a square).

In an especially advantageous feature of the device according to the invention, provision may be made for the coulisse to be adjustable by an actuator from the first position to the second position; the actuator can be controlled by an electronic control unit, especially by the method of the invention. Electromagnetic actuators as well as pneumatic and hydraulic piston and cylinder units can, for example, be used as the actuator according to the invention. The use of a bidirectional pneumatic cylinder, that is, one that can be acted upon in both directions, is advantageous because with it the coulisse can be retained very securely in the appropriate positions. The method and device of the invention can be employed in sheet-fed and web-fed rotary printing presses.

Other features which are considered as characteristic for the invention are set forth in the appended claims.

Although the invention is illustrated and described herein as embodied in a method and device for operating a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
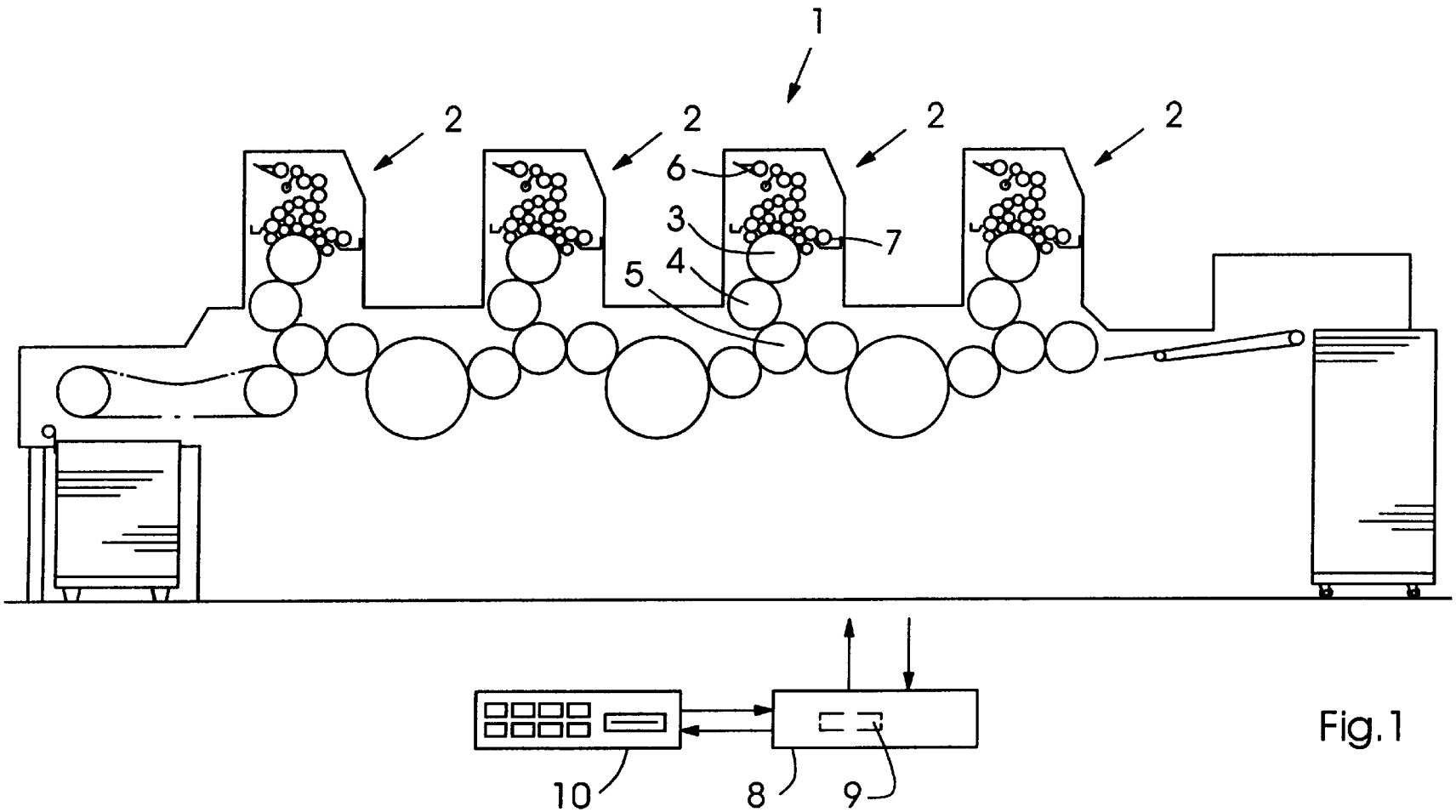
FIG. 1 is a schematic and diagrammatic side elevational view of a sheet-fed offset rotary printing press with an electronic control unit.

Identical or functionally identical parts are generally identified by like reference characters in the drawings.

Referring now to the drawings and, first, particularly to FIG. 1 thereof, there is shown therein a sheet-fed rotary printing press 1 having a plurality of printing units 2, more particularly, four thereof in the illustrated embodiment. Each printing unit 2 includes one planographic or offset printing device which, as shown, may include a printing form cylinder 3, a rubber blanket cylinder 4, and an impression cylinder 5. Each printing unit 2 also has an inking unit 6 and a dampening unit 7, which are shown in simplified form in FIG. 1. The printing press 1 is controlled by a central electronic control unit 8 with a microprocessor 9. The operator can control and vary the control processes via a control panel 10. The control unit 8 controls the printing units 2 and, in particular, the movements for engaging the cylinders 3, 4 and 5 with one another or for disengaging them from one another, as well as the inking unit 6 and the dampening unit 7 of each printing unit 2.

Figure 2:
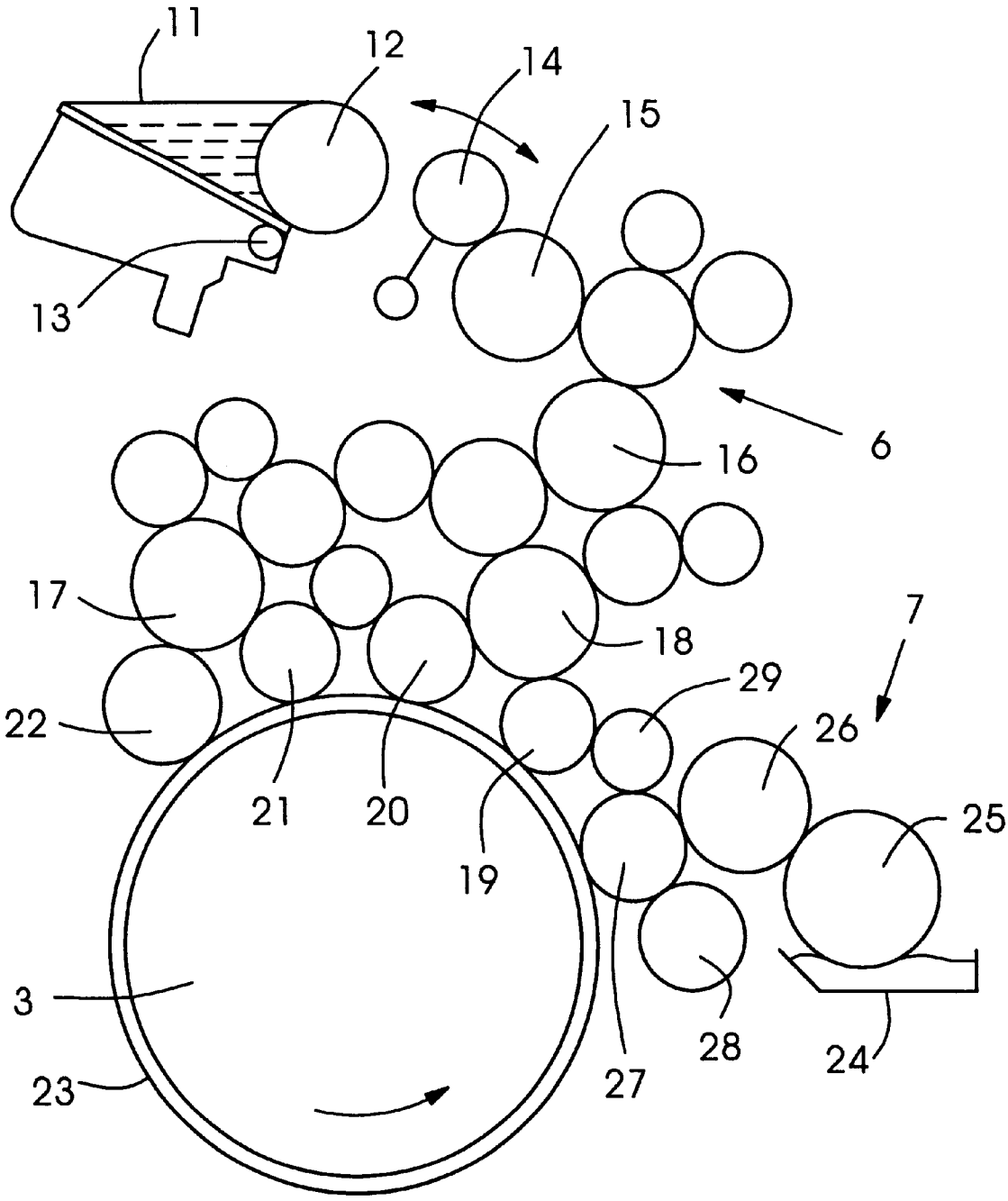
FIG. 2 is an enlarged fragmentary view of FIG. 1, showing in greater detail an inking unit and a dampening unit of the printing press.

In FIG. 2, the inking unit 6 and the dampening unit 7 of the printing press 1 of FIG. 1 are shown in greater detail. Printing ink is stored in an ink reservoir that includes the ink, an ink duct 11 and an ink duct roller 12. The ink duct 11 is equipped with a metering device 13 for zonal metering of printing ink and includes zonewide adjusting elements aligned close together and parallel to the axis of the ink duct roller 12. A reciprocatingly oscillating lifter or vibrator roller 14 transfers the printing ink from the ink duct roller 12 to a first ink distributor roller 15, the printing ink having, in the individual zonal metering regions, transverse to the printing direction, a profile of various ink layer thicknesses. In addition to the first ink distributor roller 15, the inking unit 6 also includes a second, third and fourth driven distributing roller 16, 17, 18, and a first ink applicator roller 19, as viewed in the rotary direction of the printing form cylinder 3, and further ink applicator rollers 20, 21 and 22 for applying the printing ink onto a printing form 23. The dampening unit 7 includes a panshaped dampening medium reservoir 24, into which a dipping roller 25 partly dips. A metering roller 26 is positioned so as to be in engagement with the dipping roller 25. The dipping roller 25 and the metering roller 26 can be driven at variable speed, so that, in this manner, the quantity of dampening medium supplied, for example, the quantity of dampening medium supplied per press revolution, is variable so that, during predampening, a quantity of dampening unit that is increased with respect to the printing mode can be delivered to the inking unit 6 within a short time. Furthermore, the speed of the rollers 25 and 26 can be entrained with the printing press speed as a function of the latter speed, so that constant minimal dampening for every machine speed is assured. A dampening medium applicator roller 27 rotating at the printing form cylinder speed, and the more slowly rotating metering roller 26 are positioned against one another with slip, without contact, with the formation of a gap therebetween. A dampening medium distributor roller 28 is engaged with the dampening medium applicator roller 27. An intermediate roller 29 is selectively engageable with the ink applicator roller 19 and/or the dampening medium applicator roller 27. The inking unit 6 and the dampening unit 7 can be operated in the "integrated dampening" mode, wherein the ink applicator roller 19 and the dampening medium applicator roller 27 are engaged with the printing form 23 and connected by the intermediate roller 29. In this mode, the ink applicator roller 19 carries an emulsion of ink and dampening medium. In the "separate dampening" mode, the intermediate roller 29 is separated from at least one of the applicator rollers 19 and 27. When the inking unit 6 and the dampening unit 7 are connected to one another by at least one roller, such as the intermediate roller 29, predampening of the inking unit 6 can be performed, with the ink applicator rollers 19 to 22 disengaged from the printing form 23. The dampening medium applicator roller 27 can then be disengaged from the printing form or, particularly when the printing is to start soon thereafter, it can be engaged with the printing form. Dampening medium for predampening can also be delivered to the inking unit, however, by way of different types of inking unit roller combinations. Predampening of the inking unit 6 without a roller connecting it to the dampening unit 7 can also be effected via the printing form 23.

The automatic control unit 8 shown in FIG. 1 purposefully controls the precise sequence of all functions upon startup and after a press stoppage, and during the production run adheres precisely to the desired quantity of dampening medium for each speed. The inking unit 6 and the printing form 23 are predampened by programming. The control unit 8 controls the roller positioning, in particular, the engagement of the ink applicator rollers 15 to 18 with and the disengagement thereof from other rollers and cylinders, and also controls the dosage of dampening medium in every phase. In the event of a printing interruption, all the ink and dampening medium applicator rollers 19 to 22 and 27 can be disengaged or positioned away from the printing form 23. Upon a resumption of the operation, the automatic control unit automatically trips all the necessary functions, namely, the predampening of the printing form 23 and of the inking unit 6 via the intermediate roller 29, with the dampening medium applicator roller 27 engaged with or positioned against another roller, as well as the production run with speed-compensated dampening. After the predampening, the ink applicator rollers 15 to 18 can then also be engaged with or positioned automatically against the printing form 23 for inking it. In the multicolor printing press 1 shown in FIG. 1, the automatic system of individual printing units controlled by the control unit 8 operates in precisely the correct chronological succession so that each dampening unit starts under optimal conditions.

Figure 3:
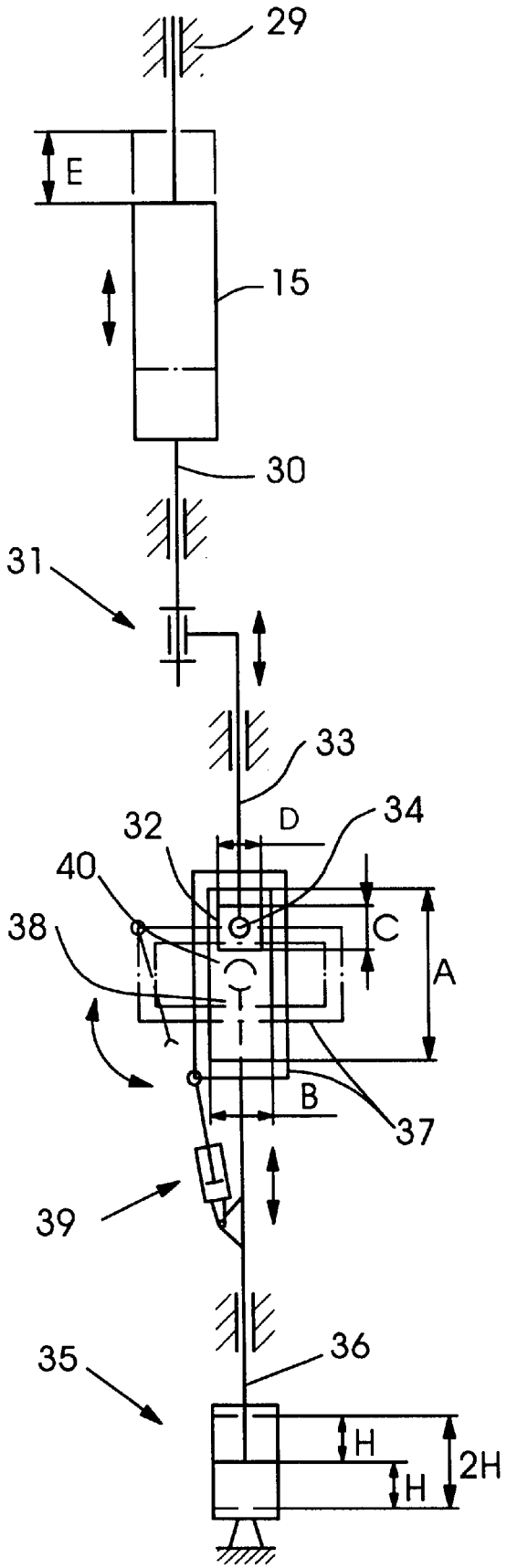
FIG. 3 is a schematic and diagrammatic view, partly in section, of a device for varying the stroke amplitude of a distributing roller.

FIG. 3 illustrates a device with which the stroke amplitude of distributor rollers, for example, the dampening medium distributor roller 28 shown in FIG. 2 and/or one or simultaneously several of the ink distributor rollers 15 to 18 can be varied. The example shown pertains to the first ink distributor roller 15, i.e., the first in the sequence of inking rollers in terms of direction of ink flow, which is supported rotatably in a frame 290, for example, in the side walls of the printing press. A journal 30 carries an entrainer 31, which allows the reciprocating motion to be transmitted to the rotating ink distributor roller 15. A sliding block 32 which, in the embodiment of FIG. 3, is square, is rotatably supported via a sliding block joint 34 in a rod 33. The rod 33 connects the entainer 31 to the sliding block 32. A distributor stroke drive 35 generates an oscillating driving motion having an amplitude H. This driving motion is transmitted by a rod 36 to a coulisse or slotted link 37, which is rotatably supported in the rod 36 via a slot joint 38. The slot joint 38 is mounted in the bottom of a groove 40. The coulisse 37 can be adjusted by an actuator 39 out of a first position shown in solid lines into a second position shown in phantom or dot-dash lines. The adjustment of the coulisse 37 relative to the sliding block 32 takes place in every phase of motion wherein the sliding block joint 34 and the slot joint 38 coincide or are aligned above one another, because the coulisse 37 and the sliding block 38 are rotated simultaneously and jointly through an angle of 90°.

When the coulisse 37 is adjusted to the first position, the stroke amplitude of the ink distributing roller 15 is different from the stroke amplitude in the second position. Depending upon the dimensional construction of the coulisse 37 and the sliding block 32, there is a resultant variable free wheeling of the difference A–C and B–D, respectively, of the sliding block 32 in the groove and with respect to the coulisse 37. In the case wherein the play A–C and B–D, respectively, is smaller than the magnitude 2H of twice the amplitude of the driving motion, entrainment or slaving of the sliding block 32 by the coulisse 37 takes place in both directions. If the play A–C and B–D, respectively, is greater or of equal magnitude, no entrainment or slaving occurs. To vary the stroke amplitude of the ink distributor roller 15, the difference A–C must be unequal to the difference B–D, assuming a constant drive amplitude H.

In the illustrated example, the play A–C of 18 mm, for example, is assumed to be slightly less, for example, by 2 mm, than the double amplitude 2H, which is 20 mm, for example, of the driving motion, so that the stroke amplitude E of the ink distributor roller 15 in both directions of motion is 1 mm (minimal stroke), respectively, if the coulisse 37 is in the first position. The play B–D that is perpendicular to the longitudinal direction and that enables smooth sliding of the sliding block 32 in the longitudinal direction is considerably less than the double amplitude 2H and, for example, at 0.05 mm, can be practically zero, so that the stroke amplitude E, when the coulisse 37 is in the second position, is greater (normal stroke) than when the coulisse 37 is in the first position, and amounts, for example, to 20 mm. Naturally, once again, as in the embodiment shown in the hereinafter following figures of the drawings, the sliding block 32 may be of cylindrical construction. In that case, C and D correspond to the diameter of the sliding block 32, and if the stroke amplitude is to be varied, A must be unequal to B. The inside surfaces which define the groove 40 in the longitudinal direction can in this case be of semicircular construction, so that the sliding block 32 and the inside surface of the coulisse 37 meet one another over the full surface, thus averting wear in the form of an unevenly worn groove 40.

Figure 4:
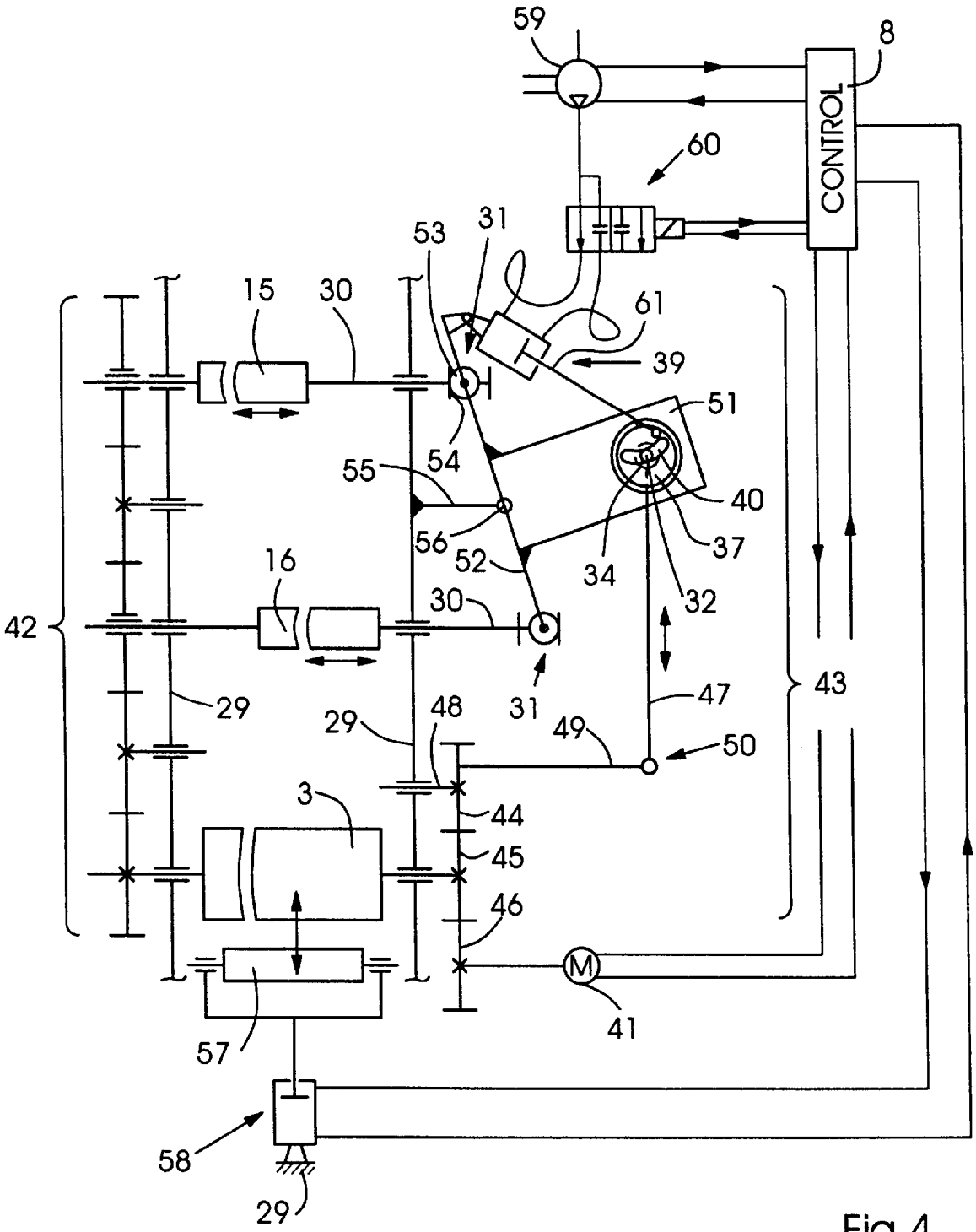
FIG. 4 is a schematic and diagrammatic view of a preferred embodiment of the device for operating a rotary printing press in accordance with the invention.

In FIG. 4, a preferred embodiment of the device according to the invention is shown. The ink distributor rollers 15 and 16 shown in FIG. 2 are displaced axially in opposite directions to one another. Provision may be made, furthermore, for additional distributor rollers, such as the ink distributor rollers 17 and 18 shown in FIG. 2 and the dampening medium distributor roller 28, to be actuated by the device. For the axial drive and for varying the stroke amplitude of these further distributor rollers, one of the ink distributor rollers 15 and 16, respectively, may be connected for driving to one or more of the further distributor rollers via a rocker of heretofore known construction (German Patent 36 29 825). The distributor rollers 15 and 16 are rotatively driven by a drive 41, coupled with the rotation of the cylinder 3 of the printing unit via a gear transmission 42, and axially via a distributor stroke gear transmission 43. For the axial and rotary drive, two separate drives may also be provided. The distributor stroke gear transmission 43 includes gearwheels 44 to 46. The gear wheel 44 functioning as a crank, together with the rod 47 functioning as a crank rod, form a crank transmission 44, 47. The gearwheel 44 has a crank journal 49, disposed eccentrically thereon relative to the gearwheel axis 48, and this journal 49 is connected to the rod 47 via a rod linkage 50. The rod 47 is connected to the sliding block 32, which is formed in FIG. 4 as a bolt. This sliding block 32 may be supported rotatably in the sliding block joint 34 of the rod 47, as shown, or may be secured to the rod 47 so as to be fixed against rotation relative thereto. The joint 50 and the sliding block joint 34 are formed as joints which are movable about two axes, respectively. Spherical shells, for example, or cardan or universal joints, can be used as the joints 34 and 50. Construction of the joints 34 and 50 as swinging roller bearings or ball bearings is preferred, with each swinging bearing being received by an eyelet on the end of the rod 47. The center axis of the inner ring of the swinging bearing of the joint 50 extends in the plane of the drawing and is equivalent to the axis of the crank journal 49 on which the inner ring sits. The center axis of the inner ring of the swinging bearing of the joint 34 extends perpendicularly to the plane of the drawing and corresponds to the axis of the sliding block 32, whereon the latter inner ring is seated. The disklike coulisse 37 has a groove 40, formed as a circular-arclike oblong slot. The coulisse 37 is rotatably supported in the lever arm 51 of the lever 52. The lever 52 has two further lever arms, each of which is connected to one of the distributor rollers 15 and 16 via the entrainers or drivers 31. The conventionally formed entrainers or drivers (German Patent 36 29 825), respectively, include an entrainer roller 53, that is guided between two disks secured to the journal 30, or in a circumferential groove 54 of the journal 30. The lever 52 is rotatably supported in a frame 29, the bracket 55 carrying the lever 52 and the joint forming the lever axis 56. An actuator 39 is disposed on the lever 52 and is braced against an outer lever arm of the three-armed lever 52 and the coulisse 37 disposed on the middle lever arm. The actuator 39 that is shown is embodied as a pneumatic cylinder that preferably acts in two directions. The actuator 39 is triggered by the electronic control unit 8 as a function of operating parameters of the printing press. One such operating parameter may, for example, be a given number of revolutions of the printing form cylinder 3. The control unit 8 controls both the drive 41 of the printing press and of the printing unit, respectively, as well as the actuator 39. The control unit 8 can also control the positioning of the ink applicator roller 57 and the dampening medium applicator roller, not shown in FIG. 4, towards and away from other cylinders, i.e., into and out of engagement therewith. To that end, the control unit 8 triggers an applicator roller actuator or drive 58 that positions the applicator roller 57 towards and away from other cylinders. Provision may also be made for the drive 58 to actuate not only the applicator roller 57 but also the coulisse 37, instead of the additional actuator 39. Also apparent from FIG. 4, as an example of all the aforementioned pneumatic cylinders, is that these cylinders are supplied with compressed air from a compressed air source 59 via a valve 60. Hydraulic systems can also be employed. The valve 60 that is shown is embodied as a multiway valve and is controlled by the control unit 8, for example, by being magnetically actuated. Via the valve 60, a piston rod 61 of the bidirectional pneumatic cylinder can be selectively extended and retracted. The piston rod 61 is connected to the coulisse 37 via a joint 62, so that the slot 40 of the coulisse 37 can be rotated by the actuator 39 around the slot joint 34. The rotary angle may be defined by additional stops.

The operation is as follows: The rod 47 executes an oscillating push and pull motion, which is transmitted to the coulisse 37 via the sliding block 32 engaging over the groove 40. In the first shown position of the coulisse 37 (with entrainment or slaving), this distributor stroke drive motion is transmitted to the coulisse 37 and the lever 52 with lesser idle travel of the sliding block 32 in the coulisse 37 than in a non-illustrated second position (without entrainment or slaving), that is substantially perpendicular to the first position. Because of the reduced or practically absent idle travel, entrainment or slaving of the lever 52 is accomplished over a larger pivoting angle. The oscillating distributor rollers 15 and 16 then, for example, execute one complete swing or oscillation back and forth per two revolutions of the printing form cylinder 3, or one stroke from the center position to a dead center position and back again per revolution.

The lever 52 thus forms the first transmission member and the rod 47 forms the second transmission member of the distributor stroke transmission 43, the coulisse 37 being adjustable and in particular rotatable relative to the lever 52. Both the lever 52 and the rod 47 are driven by the drive 41. The lever 52 consequently executes a swinging or oscillating pivoting motion about the lever axis 56 thereof and simultaneously displaces the rotating distributor rollers 15 and 16 in opposite axial directions. In FIG. 4 of the drawings, one of two dead center positions of the system is shown. After a rotation of the coulisse 37 through an angle of 90° to the second position, the sliding block 32 has greater idle travel, so that the coulisse 37 and the lever 52 cannot be moved back and forth at all, or can be so moved only over a smaller pivoting angle. Both of these latter two cases are equivalent to the minimal stroke.

Figure 5:
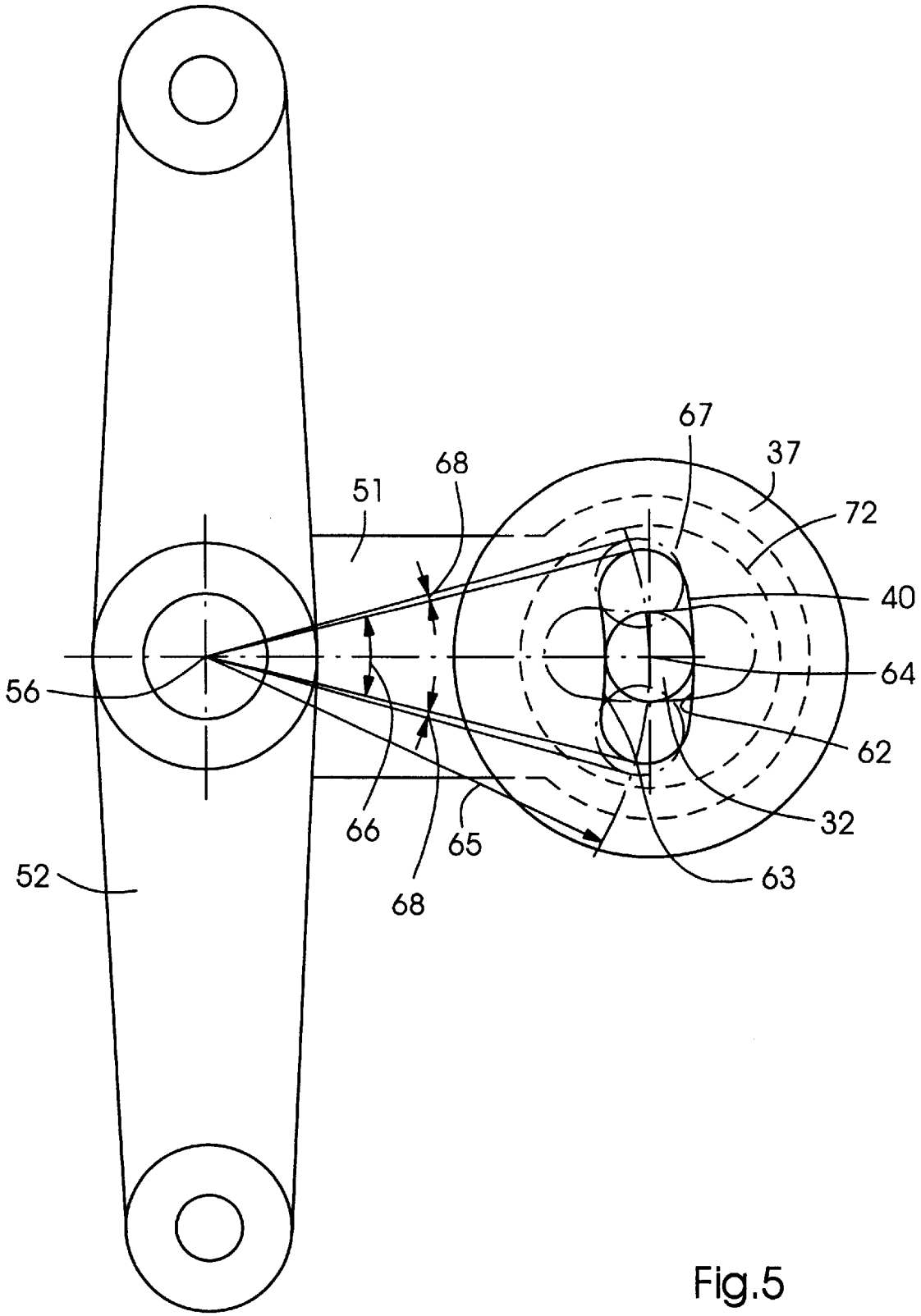
FIG. 5 is an enlarged fragmentary view of FIG. 4, showing in greater detail a lever forming part of the operating device according to the invention.

In FIG. 5, the lever 52, which is rotatable about the lever axis 56 and forms the first transmission member, is shown in greater detail. The coulisse 37 is carried by the lever arm 51 and is supported in the lever arm 51 in a bore 67 so as to be rotatable about the axis 64 of the coulisse 37. The sliding block 32 has a circular cross section, and the groove 40 is an oblong slot in the form of a circular arc. Inner faces 62 and 63 defining the groove 40, in the second position, extend concentrically to the lever axis 56. A mean radius 65 of the groove 40 corresponds to the spacing between the lever axis 56 and the coulisse axis 64. The arc length 66 of the mean radius is equivalent to the groove length A of the rectilinearly extending groove 40 shown in FIG. 3. The groove 40 is disposed centrally with respect to the slot axis 64. The sliding block 32 is also shown in phantom, i.e., represented by dot-dash lines, in the two dead center positions of the oscillating driving motion. It is apparent that the sliding block 32, in its motion, moves past the groove length, for example, in the case of the circular-arclike groove 40 shown here, a distance corresponding to the arc length enclosed by the pivoting angle 68, respectively. In this manner, a minimal stroke of the distributor rollers 15 and 16 of one millimeter, for example, can be produced. If the groove 40 is longer and if the driving motion is over a shorter path, respectively, the pivoting angle 68 can be zero (impact without entrainment or slaving), or the sliding block 32 does not at all strike the inside surfaces defining the groove which are located in the direction of motion thereof. In these cases, the minimal stroke of the stroke amplitude of the distributor rollers is equal to zero. In FIG. 5, the first position of the coulisse 37 is suggested by the corresponding position (shown in phantom or in dot-dash lines) of the groove 40. In this position, entrainment or slaving of the coulisse 37 by the sliding block 32 takes place over a longer distance, so that an increased stroke amplitude of the distributor roller, in comparison with the minimal stroke, is produced.

Figure 6:
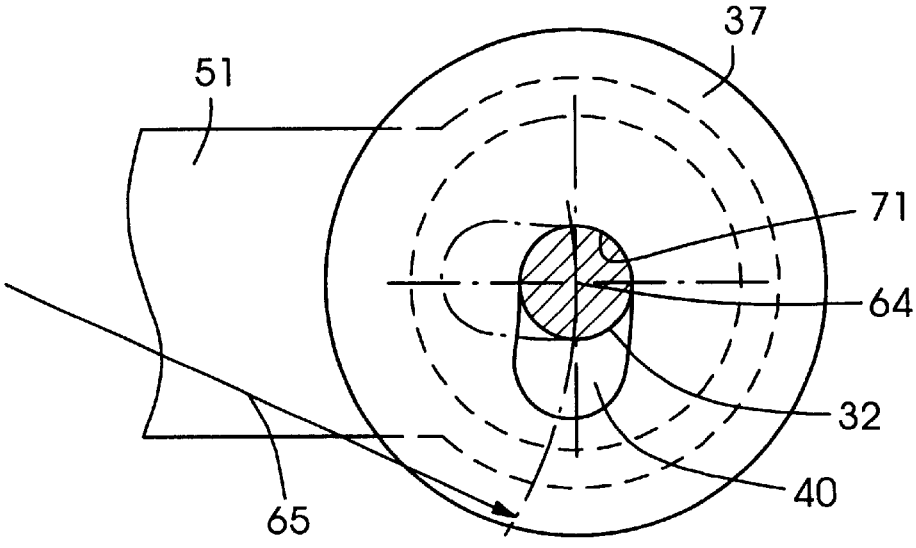
FIG. 6 is an enlarged fragmentary view of FIG. 5, showing an advantageous construction of a coulisse or slotted lever according to the invention.

In FIG. 6, a preferred embodiment of the groove 40 is shown. The modification with respect to the embodiment shown in FIG. 5 resides in the location of the groove 40 that is shifted along a circular arc having a radius 65 extending from the lever axis 56, so that the rounded inner surface 71 of the groove 40 located in the direction of motion of the sliding block 32 extends coaxially to the coulisse axis 64. In this manner, an especially rapid and reliable adjustment of the stroke amplitude can be realized, which is preferably performed in the dead center position 4 of the pushing motion of the rod 47, as shown in FIG. 4, the actuator 39 being able to be activated already before this position is reached. Non-illustrated stops which limit the adjusting travel or angle of the coulisse 37 can also be provided.

Figure 7:
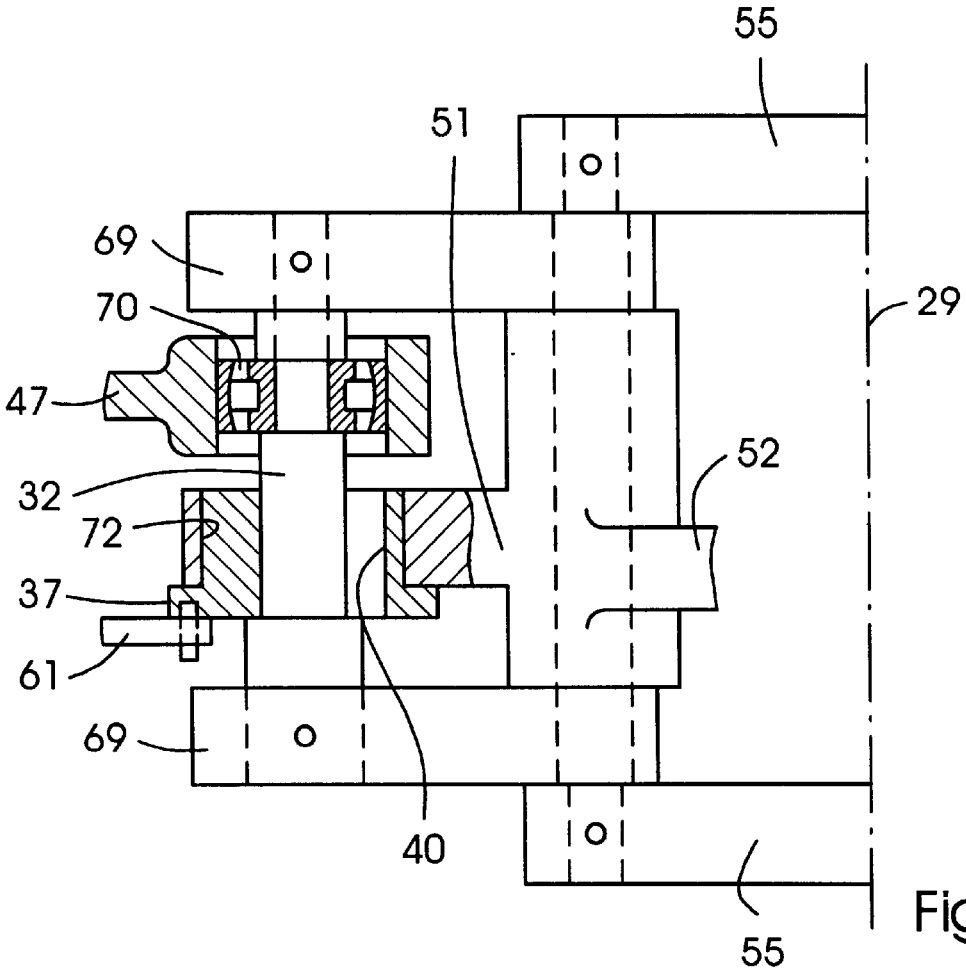
FIG. 7 is a diagrammatic lefthand side elevational view, partly broken away and in section, of FIG. 5, showing the lever mounted in a bearing therefor.

In FIG. 7, a preferred embodiment of the bearing of the lever 52, the sliding block 32 and the coulisse 37 is shown in a side elevational view. The sliding block 32 is embodied as a bolt, which is supported in the rod 47 and in at least one further lever 69. The bearing and, in particular, the bearing in two further levers 69, serves the purpose of bearing stabilization of the sliding block 32 and minimizes wear of the groove 40 by preventing a tilting motion of the sliding block 32 in the groove 40 as a consequence of the driving force. In this manner, play between the groove 40 and the sliding block 32 can be made sufficiently large to enable especially smooth adjustment of the coulisse 37. The bearing of the sliding block 32 in the rod 47, which in this case forms the second transmission member of the distributor stroke transmission, can advantageously be provided by a swinging or oscillating roller bearing 70.

Figure 8A:
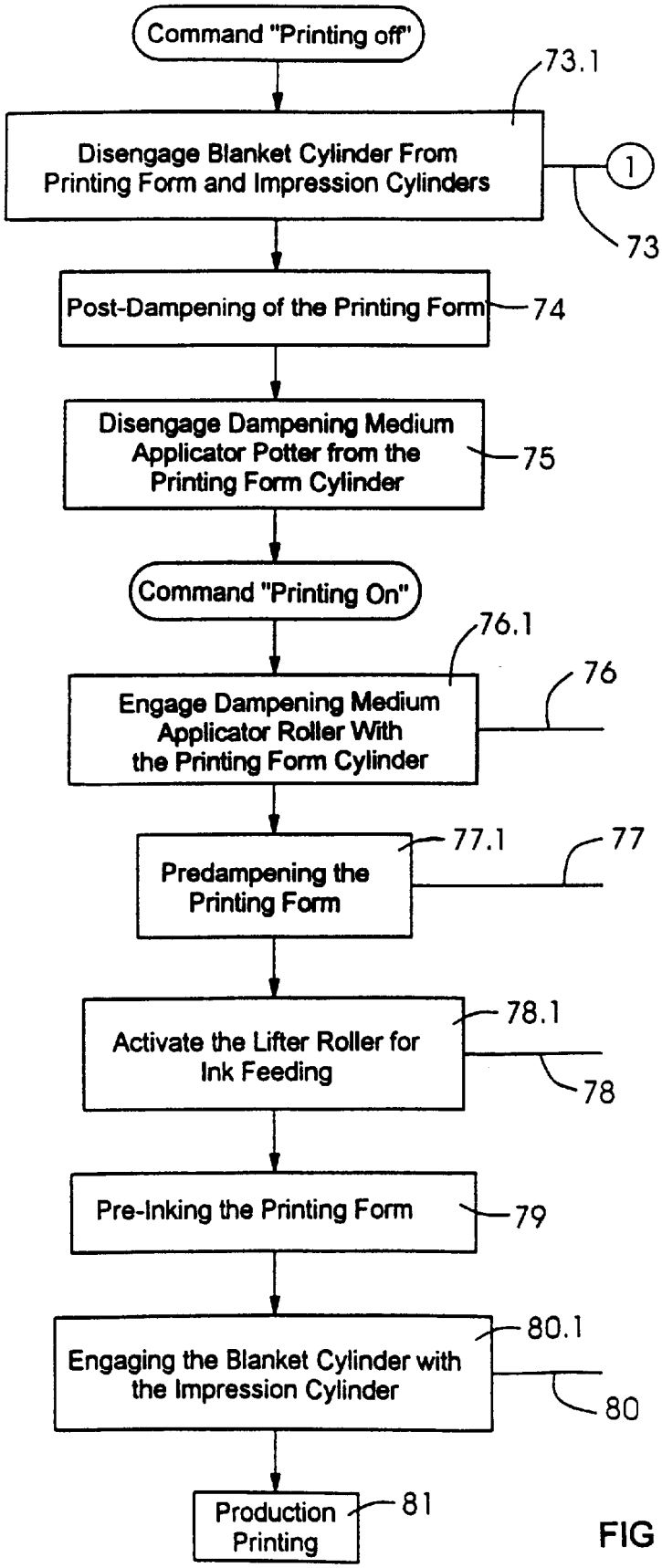
FIGS. 8*a* and 8*b*, together, are a flowchart depicting how the electronic control unit of the printing press triggers the device according to the invention for performing the method of operating a rotary printing press according to the invention.
Figure 8B:
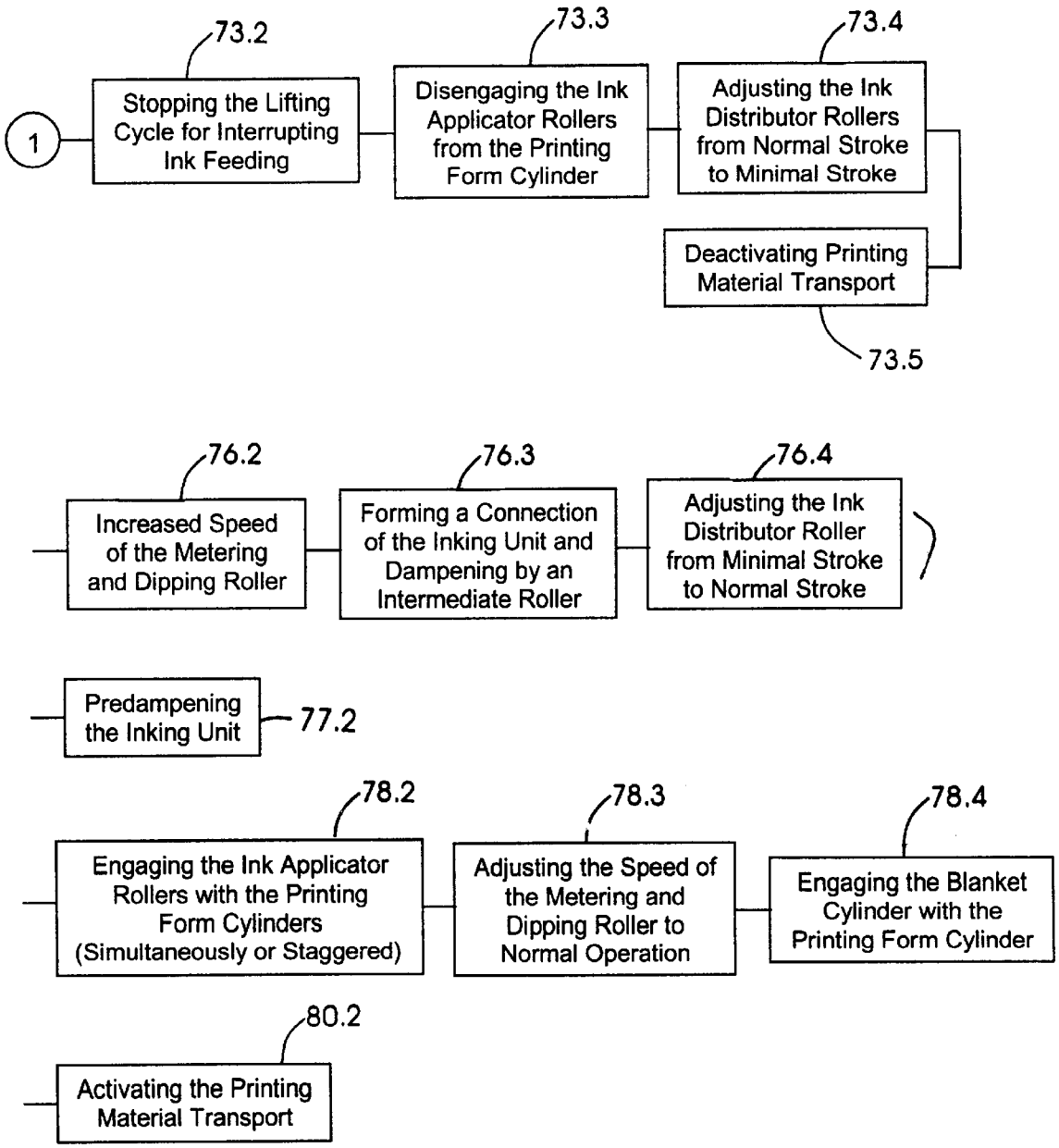

In FIGS. 8*a* and 8*b,* viewed together, there is shown a flowchart with program steps 73 to 81 to be executed in accordance with the method of the invention by the electronic control unit 8 for controlling the operation of the rotary printing press 1. After a signal commanding "printing off", that is tripped by the pressman by pressing a button, program step 73 then includes, in parallel, disengaging or positioning the rubber blanket cylinder away from the printing form cylinder and impression cylinder 73.1, stopping the lifter cycle to interrupt ink delivery 73.2, disengaging or positioning the ink applicator rollers away from the printing form cylinder 73.3, adjusting the ink distributor roller from the normal stroke to the minimal stroke 73.4, and deactivating the transport of the printing material 73.5. In the case wherein the stroke amplitude is set in a programmed manner by the control unit 8 to a minimal stroke greater than zero, then as needed, for example, if a printing interruption that lasts a comparatively long time occurs, manual stoppage of the distributor roller (stroke amplitude equal to zero) is performed by the pressman. This can be effected by pressing a button to send a command to the control unit 8, or by mechanical adjustment of the device. In the next program step 74, redampening or postdampening of the printing form is performed, and in the program step 75 that follows thereafter, the dampening medium applicator roller is disengaged or positioned away from the printing form cylinder. After the signal commanding "printing on" has been tripped by the pressman who has pressed a button, a plurality of parallel events take place in program step 76: positioning the dampening medium applicator roller against the printing form cylinder 76.1, i.e., bringing the roller and the cylinder into mutual engagement, increasing the rotary speed of the metering and dipping roller 76.2, establishing a connection of the inking unit with the dampening unit by the intermediate roller 76.3, and adjusting the ink distributor roller from minimal stroke to normal stroke. In the next program step 77, predampening of the printing form 77.1 and of the inking unit 77.2 take place, for example, within from 3 to 5 machine revolutions. In the next program step 78, the following actions take place in parallel: activating the lifter roller to feed printing ink to the inking unit 78.1, positioning the ink applicator rollers against the printing form cylinder 78.2, i.e., bringing the rollers and the cylinder into mutual engagement, a step which can be effected simultaneously or in staggered order, adjusting the rpm of the metering and dipping roller to normal operation 78.3, and positioning the rubber blanket cylinder against the printing form cylinder 78.4, i.e, bringing both cylinders into mutual engagement. This is followed by pre-inking the printing form in program step 79, for example, within several machine revolutions. In program step 80, the rubber blanket cylinder is positioned against the counterpressure cylinder 80.1, i.e., the cylinders are brought into mutual engagement, and the transporting of printing material is reactivated 80.2, so that a production run status in accordance with program step 81 is then attained.

We claim:

1. A device for varying the stroke amplitude of at least one axially oscillating distributor roller in an application unit of a rotary printing press, wherein a distributor roller is drivable by a distributor stroke drive via a distributor stroke transmission including a coulisse having a groove and being adjustable from a first position to a second position, and a sliding block movable in the groove, comprising:

a first transmission member carrying the coulisse, and a second transmission member carrying the sliding block, the distributor stroke transmission being formed of said first and said second transmission members, said coulisse being disposed adjustably relative to said first transmission member, and both said first and said second transmission members being driven by the distributor stroke drive; and an actuator for adjusting said coulisse, said actuator being carried by at least one of said first and said second transmission members.

2. The device according to claim 1, wherein an oscillating driving motion is transmissible from one of said first and said second transmission members to the other of said first and said second transmission members, and the coulisse and the sliding block are cooperable with one another for forming an entrainer.

3. The device according to claim 1, wherein the coulisse in the first position thereof is substantially perpendicular thereto in the second position thereof.

4. The device according to claim 1, wherein said first transmission member is embodied as a lever pivotable about a lever axis.

5. The device according to claim 1, wherein the coulisse is rotatable about a coulisse axis, and the groove is formed as a circular arc.

6. The device according to claim 5, wherein said first transmission member is a lever pivotable about a lever axis, and wherein a mean radius of the groove has a length equivalent to a spacing between said lever axis and said coulisse axis.

7. The device according to claim 4, wherein said lever is formed as a multi-armed lever having a lever arm supporting the coulisse.

8. The device according to claim 7, wherein said lever is constructed for moving at least two distributor rollers opposite to one another.

9. The device according to claim 1, including an electronic control unit for controlling said actuator to adjust the coulisse.

10. A rotary printing press including the device for varying the stroke amplitude of at least one axially oscillating distributor roller according to claim 1.

* * * * *